8/5/86 OR 4,604,548 SR

United States Patent [19]

Hernqvist et al.

[11] Patent Number: 4,604,548

[45] Date of Patent: Aug. 5, 1986

[54] ELECTRON GUN WITH AFTERGLOW ELIMINATOR

[75] Inventors: Karl G. Hernqvist, Princeton; Roger C. Alig, Princeton Junction, both of N.J.

[73] Assignee: RCA Corporation, Princeton, N.J.

[21] Appl. No.: 154,237

[22] Filed: May 29, 1980

[51] Int. Cl.[4] ..... H01J 29/50

[52] U.S. Cl. ..... 313/414; 313/360.1

[58] Field of Search ..... 313/412, 414, 424, 360, 313/449

[56] References Cited

U.S. PATENT DOCUMENTS

| | | | |
|---|---|---|---|
| 2,732,511 | 1/1956 | Dichter | 313/460 |
| 3,772,554 | 11/1973 | Hughes | 313/414 |
| 3,987,328 | 10/1976 | Yoshida et al. | 313/414 |
| 4,137,480 | 1/1979 | Torre et al. | 313/481 |
| 4,232,246 | 11/1980 | Sakurai et al. | 313/414 |

FOREIGN PATENT DOCUMENTS

| | | | |
|---|---|---|---|
| 55-91540 | 7/1980 | Japan | 313/414 |

*Primary Examiner*—David K. Moore

*Attorney, Agent, or Firm*—Eugene M. Whitacre; Dennis H. Irlbeck; Vincent J. Coughlin, Jr.

[57] ABSTRACT

The present invention is an improvement in an electron gun for use in a cathode ray tube. Such gun includes at least one cathode and a plurality of electrodes spaced from the cathode. At least two of the electrodes form a main focusing lens and the electrode nearest the cathode which forms the main focusing lens includes extrusions about an aperture therein. The improvement comprises means located at the end of the gun opposite the cathode for blocking the exit from the gun of electrons emitted from the extrusions.

2 Claims, 7 Drawing Figures

ELECTRON GUN WITH AFTERGLOW ELIMINATOR

This invention relates to electron guns for cathode ray tubes and particularly to means added to electron guns for eliminating afterglow on a cathode ray tube screen after the set containing the tube has been turned off.

BACKGROUND OF THE INVENTION

Most television sets are provided with a bleeder for the high voltage power supply, wherein, after the set has been switched off, the current to the screen and the light output from the screen quickly drop to zero. However, the bleeder adds significantly to the cost of the set and some sets are not provided with bleeders and thus the charge remains in the filter capacitor and the high voltage may linger on for minutes or even hours. Beam currents of non-thermionic origin may then excite the phosphors in the screen. This phenomenon is referred to as "afterglow" and is objectional.

Typically 30% of manufactured tubes may show afterglow. Repeated high voltage processing can bring this figure to below 5%, still an unacceptably high reject rate. Therefore, there is a need for improved cathode ray tubes that do not show any afterglow.

SUMMARY OF THE INVENTION

The present invention is an improvement in an electron gun for use in a cathode ray tube. Such gun includes at least one cathode and a plurality of electrodes spaced from the cathode. At least two of the electrodes form a main focusing lens and the electrode nearest the cathode which forms the main focusing lens includes extrusions about an aperture therein. The improvement comprises means located at the end of the gun opposite the cathode for blocking the exit from the gun of electrons emitted from the extrusions.

DETAILED DESCRIPTION OF THE PREFERRED EMBODIMENT

Figure 1:
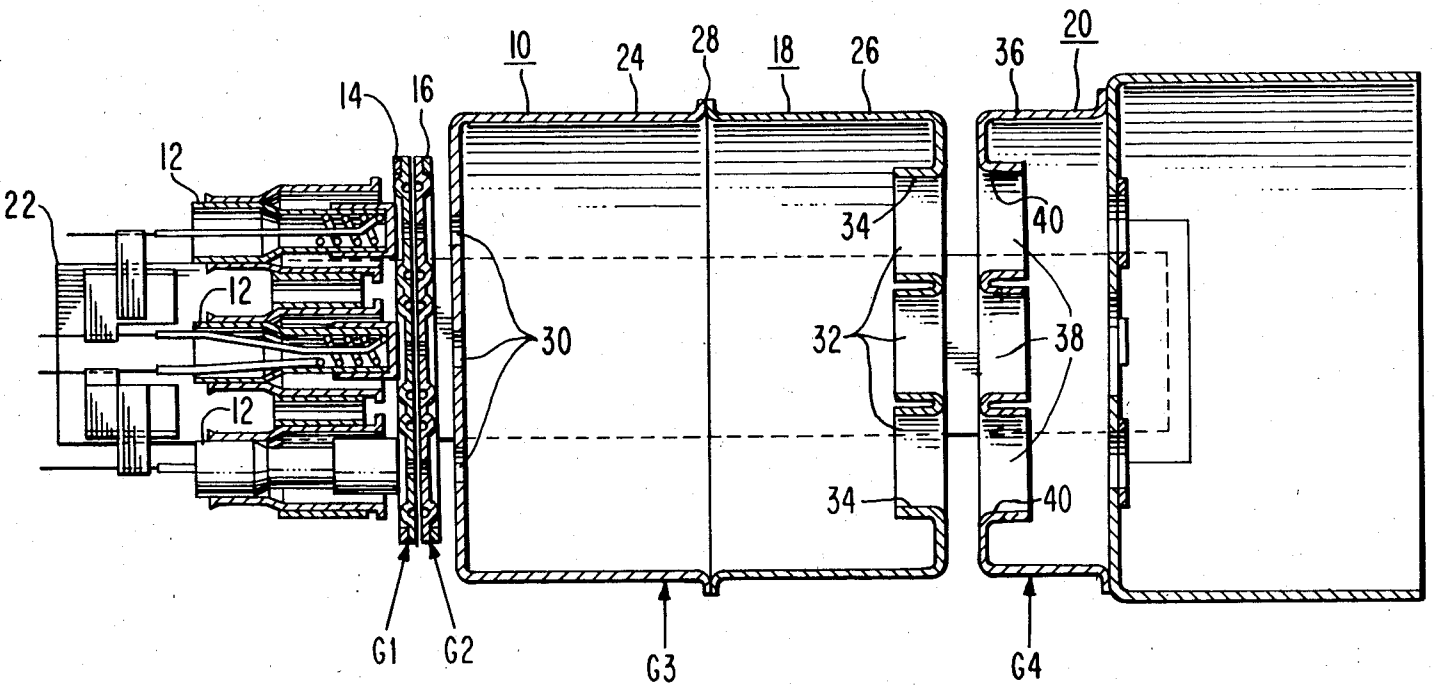
PRIOR ART Fig. 1.
FIG. 1 is a longitudinal section view of a prior art three-beam inline electron gun.

FIG. 1 illustrates a prior art electron gun 10. Such an electron gun 10 is of the three-beam in-line type similar to that described in U.S. Pat. No. 3,772,554 issued to R. H. Hughes on Nov. 13, 1973, which is hereby incorporated by reference for the purpose of disclosure.

The electron gun 10 comprises three tubular in-line cathodes 12, a control grid (G1) 14, a screen grid (G2) 16, and two lens electrodes consisting of a focus electrode (G3) 18 and an accelerating electrode (G4) 20. The cathodes, grids, and lens electrodes are mounted in predetermined spaced relation on a pair of insulator support rods 22. The G1, G2, G3, and G4 are each provided with three in-line apertures aligned with the three cathodes through which three co-planar in-line electron beams are projected.

The lens electrode G3 comprises a pair of tub-shaped cups 24 and 26 joined together at their open ends 28. The tubs 24 and 26 have a dimension from top to bottom as shown in FIG. 1 which is significantly longer than the dimension of the tubs in the direction perpendicular to the plane of the drawing. The tub 24 is provided with three apertures 30 in the floor of the tub through which electron beams enter the G3 electrode. The tub 26 is provided with three relatively larger apertures 32 in its floor through which the electron beams exit from the G3 electrode. The exit apertures 32 are provided with tubular lips or extrusions 34 which extend inwardly into the interior of their associated tub 26.

The lens electrode G4 also includes a tub-shaped element 36 having three apertures 38 therein which face the three apertures 32 of the G3 electrode. In a similar manner, the G4 apertures 38 have tubular lips or extrusions 40 which project inwardly into the interior of their associated tub 36.

Figure 2:
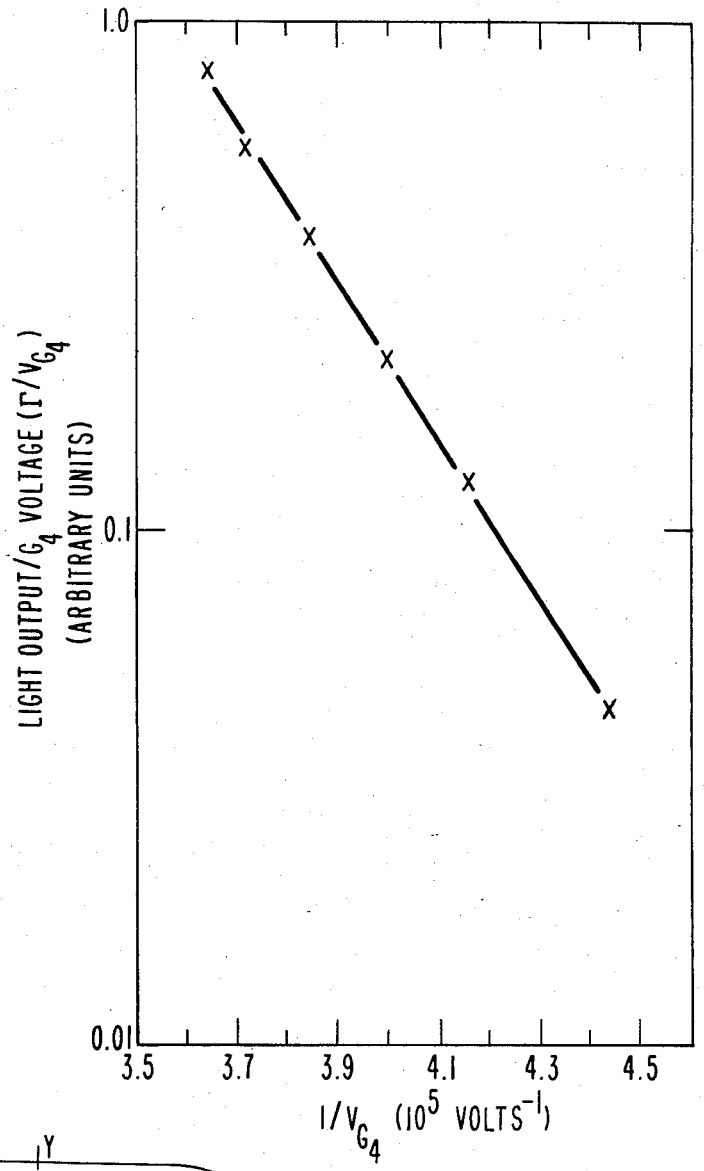
FIG. 2 is a graph of light output divided by G4 electrode voltage versus the inverse of the G4 electrode voltage.

Studies were performed on several cathode ray tubes, having electron guns similar to the electron gun 10, which all exhibited afterglow. The tubes were operated with the heaters off and the following voltages applied: G1 and G2 $=-200$ volts, G3$=0$, and G4 varied between 20 kV and 30 kV. Light output $\Gamma$ at the screen was monitored by a phototube pressed up against the screen at the position of the afterglow spots. The light output $\Gamma$ versus the G4 electrode voltage $v_{G4}$ was measured. It was assumed that light output $\Gamma$ is proportional to $I \cdot V_{G4}$ where I is the current to the screen. Thus if $\Gamma/V_{G4}$ is plotted versus $V_{G4}^{-1}$, as shown in FIG. 2, the functional dependence of I on $V_{G4}$ is obtained. The graph of FIG. 2 shows an exponential dependence, indicative of a field emission source. Raising the G3 potential lowered the light output of the afterglow spots, indicating that the sources of the current causing the afterglow are field emission sites on the G3.

Figure 3:
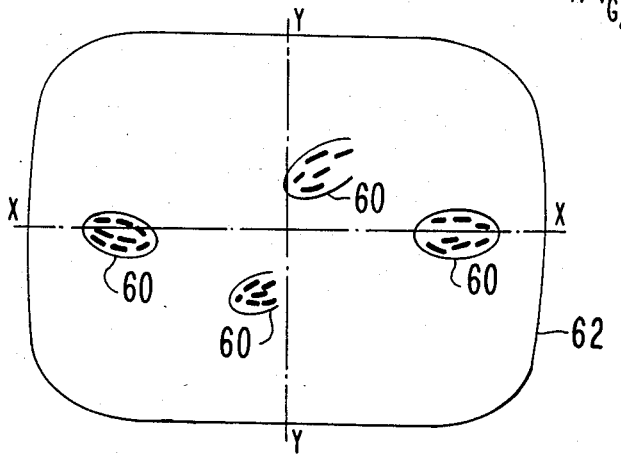
FIG. 3 is a front view of a cathode ray tube screen showing typical afterglow patterns.

Observations of the afterglow pattern on the screens of several cathode ray tubes showed groups of spots 60 which were consistently located at four specific positions on the screens 62, as shown in FIG. 3. Two of these positions were widely spaced along the horizontal axis X—X and two were closely spaced along the vertical axis Y—Y. These patterns were copied on a piece of plexiglass, which was then set up in front of a section of neckglass with an electron gun to stimulate the cathode ray tube geometry. Direct viewing as well as tracing with a laser beam indicated that there was straight line of sight from the spots on the screen to the lower inside walls of the extrusions 34 at the apertures 32 or G3. The observed patterns are consistent with an assumption that circularly symmetric beamlets limited by two cones, emerge from the G3 aperture. Some of these beamlets are intercepted by the G4 electrode and by the neckglass and funnel to create the observed pattern. Applying this model, the two groups of spots 60 along the horizontal axis X—X originate from the two outer G3 apertures, the left group originating from the right aperture and the right group originating from the left aperture. The groups along the vertical axis Y—Y originate from the middle aperture. These latter beamlets pass through the middle G4 aperture. Computer calculations of electron rays originating from field emission sites at the G3 aperture extrusions 34 were undertaken to corroborate these observations.

Figure 4:
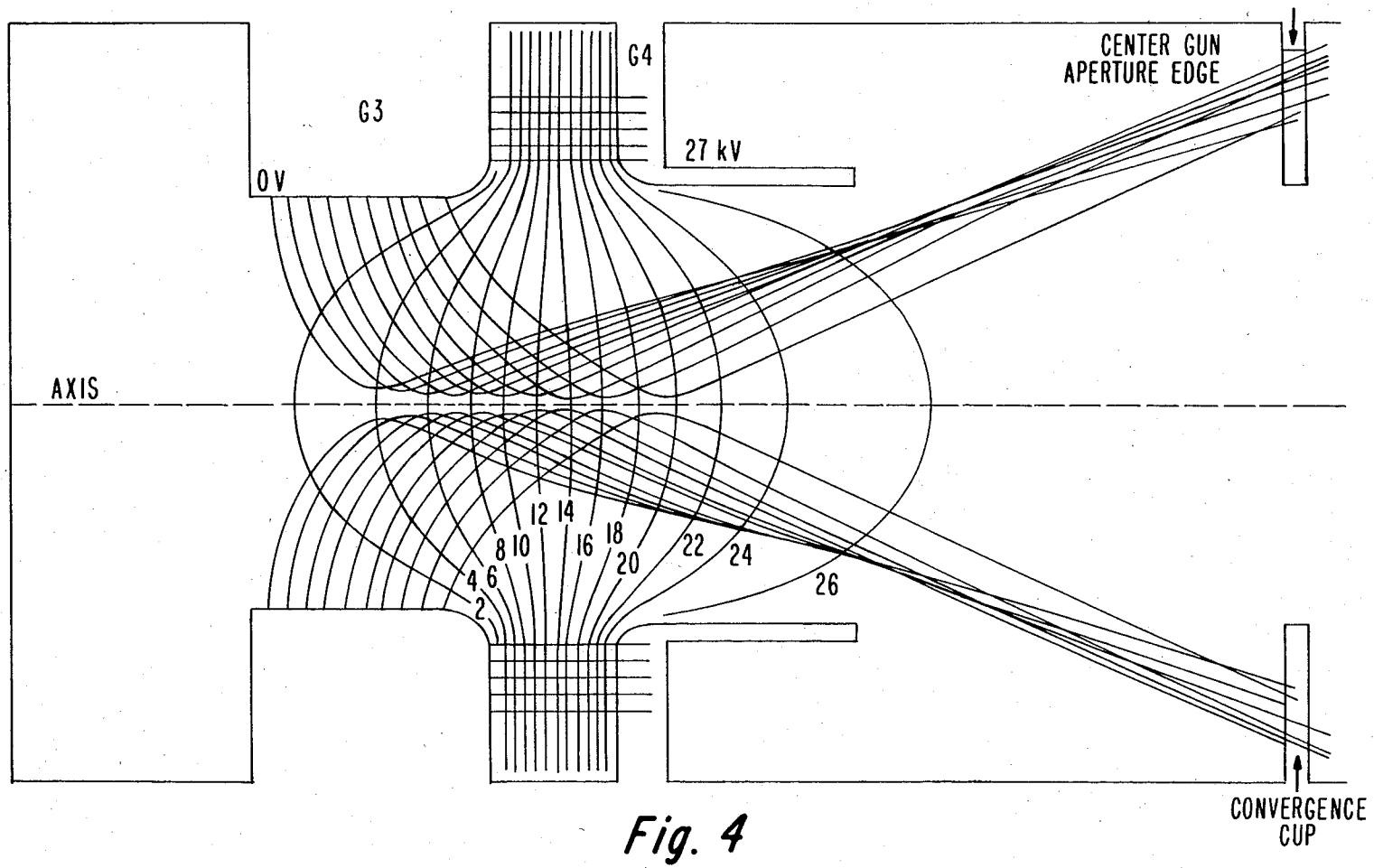
FIG. 4 is a plot of electron beam trajectories for an outer beam path of an electron gun and selected equipotential wherein the trajectories originated on the G3 electrode extrusions.
Figure 5:
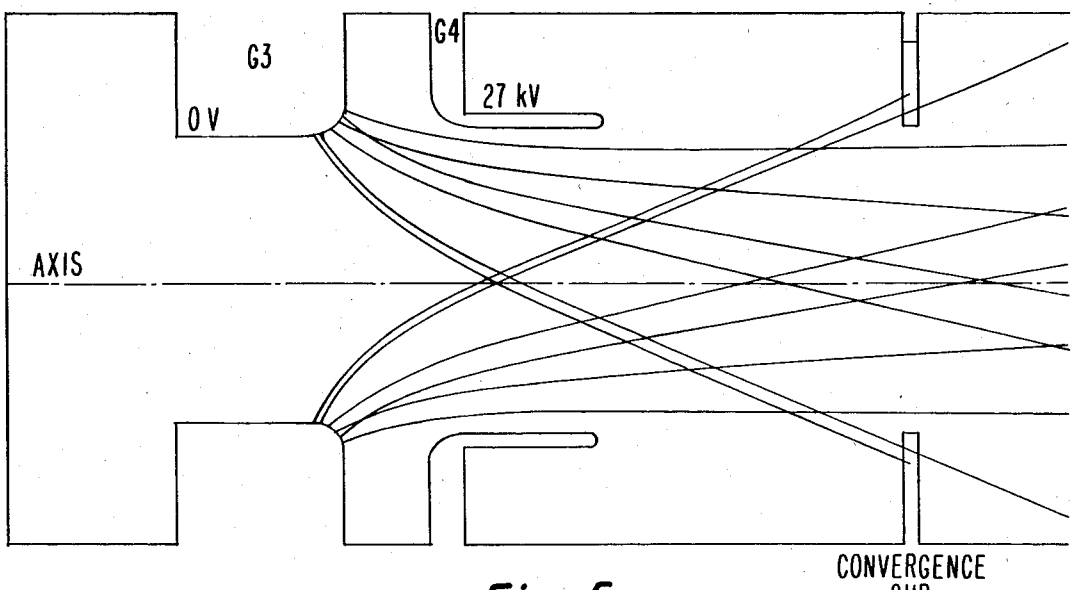
FIG. 5 is a plot similar to the plot of FIG. 4 except that the electron beam trajectories originate near the front of the G3 electrode extrusions.

A computer program was used to model the trajectories of electrons emitted from the G3 aperture extrusions 34. A computer plot of these trajectories and selected equipotentials is shown in FIG. 4. This figure shows the cross-section for an outer electron beam path. The gun is cylindrically symmetric about the axis. Portions of the G3 and G4 electrodes are shown having electrical potentials of 0 and 27 kV, respectively. The curved lines between the G3 and G4 are equipotential lines labelled in kilovolts. Electrons are seen to originate on the G3 extrusions 34 on the outer side of the gun and to terminate on the bottom of the G4 cup close to the aperture edge of the center gun. A slight change in the model, e.g., due to a part misalignment, or in the calculation, e.g., due to a correction for the loss of cylindrical symmetry near the center gun, could lead to trajectories penetrating the center gun aperture. A similar diagram showing additional trajectories is shown in FIG. 5. In this diagram, electron trajectories originating near the beginning of the G3 extrusions 34 are seen to escape from the shield cup aperture of that gun.

Figure 6:
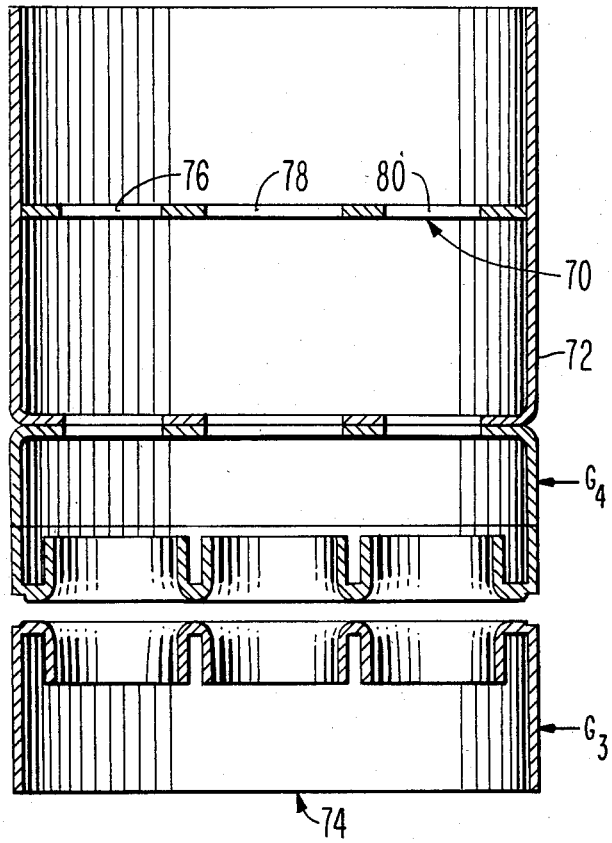
FIG. 6 is a longitudinal section view of a portion of an improved electron gun.

As previously shown, beamlets originating from the inside of the G3 extrusions 34 are most likely to emerge through the G3 aperture at off axis directions. Some of these beamlets pass through the corresponding G4 apertures and shield cup apertures to reach the screen, causing the aforementioned afterglow. These beamlets can be caught by a novel apertured plate 70 located in the shield cup 72 of an electron gun 74, as shown in FIG. 6. The apertured plate 70 is disc-shaped and includes three apertures 76, 78 and 80 which are aligned with the apertures in the G3 and G4 along the intended electron beam paths. Tests performed on a group of 30 cathode ray tubes using the apertured plate 70 yielded no rejects for afterglow.

Figure 7:
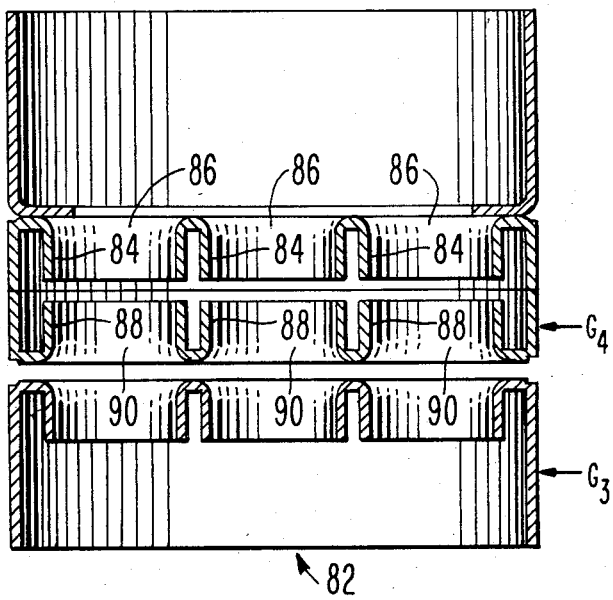
FIG. 7 is a longitudinal section view of a portion of another improved electron gun.

Another novel electron gun embodiment 82 for decreasing afterglow is shown in FIG. 7. As noted, some afterglow is caused by beamlets from the G3 crossing over inside the G4 electrode and emerging through the shield cup apertures to strike the screen. These crossover beamlets can be blocked by the addition of extrusions 84 to the exit apertures 86 of the G4 electrode, as shown in FIG. 7. The exit aperture extrusions 84 in combination with extrusions 88 on the main focus apertures 90 on the G4 block most of the cross over beamlets. Tests performed on a group of 30 cathode ray tubes using electron guns having the extrusions 84 on the exit apertures 86 of the G4 yielded 3 rejects for afterglow.

What is claimed is:

1. In an electron gun for use in a cathode-ray tube, said gun including at least one cathode and a plurality of electrodes, each of said electrodes having a beam aperture aligned along an axis and spaced from the cathode, at least two of said electrodes forming a main focus lens, the electrode nearest said cathode which forms the main focus lens including an extrusion about the beam aperture therein and the other electrode of the main focus lens having a shield cup thereon, the improvement comprising a plate having a plate aperture aligned with the beam apertures in said electrodes, said plate being located within and spaced from the bottom of said shield cup at the opposite end of said gun from said cathode, for blocking the exit from said gun of electrons emitted from said extrusion and emerging at an off-axis direction from said beam aperture of the electrode of the main focus lens nearest the cathode to reduce afterglow caused by off-axis electrons.

2. In an electron gun for use in a cathode ray tube, said gun including three inline cathodes and a plurality of unitized electrodes, said electrodes including a control grid, a screen grid, a main focus lens comprising a focus electrode and an accelerating electrode, and a shield cup on said accelerating electrode, said electrodes being spaced from said cathodes in the order named, each of said electrodes and said shield cup including beam apertures therein corresponding to electron beam paths, said focus electrode having extrusions about the beam apertures therein, the improvement comprising a plate having three plate apertures aligned with the beam apertures in said electrodes and in said shield cup along the electron beam paths, said plate being located within and spaced from the bottom of said shield cup at the opposite end of said gun from said cathodes for blocking the exit from said gun of electrons emitted from said extrusions and emerging at a direction off said beam paths from said beam apertures of said focus electrode to reduce afterglow caused by off-axis electrons.

* * * * *